US010486176B2

(12) United States Patent
Sell

(10) Patent No.: US 10,486,176 B2
(45) Date of Patent: Nov. 26, 2019

(54) DOSING DISPENSERS AND METHODS FOR USING THE SAME

(71) Applicant: WestRock Dispensing Systems, Inc., Norcross, GA (US)

(72) Inventor: Steven A. Sell, Lee's Summit, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 174 days.

(21) Appl. No.: 15/196,762

(22) Filed: Jun. 29, 2016

(65) Prior Publication Data

US 2017/0001207 A1 Jan. 5, 2017

Related U.S. Application Data

(60) Provisional application No. 62/188,016, filed on Jul. 2, 2015.

(51) Int. Cl.

| | |
|---|---|
| ***B05B 7/24*** | (2006.01) |
| ***B05B 7/12*** | (2006.01) |
| *B05B 1/30* | (2006.01) |

(52) U.S. Cl.

CPC ..... *B05B 7/2443* (2013.01); *B05B 7/12* (2013.01); *B05B 1/3026* (2013.01)

(58) Field of Classification Search

CPC ..... B05B 1/3026; B05B 7/2443; B05B 7/244; B05B 7/2478; B05B 7/30; B01F 5/0413

USPC .... 239/310, 318, 302, 323, 570, 396, 581.1, 239/581.2, 456–458; 222/324

See application file for complete search history.

(56) References Cited

U.S. PATENT DOCUMENTS

| | | | | |
|---|---|---|---|---|
| 3,746,262 | A * | 7/1973 | Bete | B05B 1/12 239/458 |
| 4,901,923 | A * | 2/1990 | McRoskey | B05B 7/2443 239/123 |
| 2012/0234935 | A1* | 9/2012 | Sun | B05B 1/3013 239/10 |
| 2014/0209706 | A1* | 7/2014 | Jia | B05B 7/32 239/315 |

* cited by examiner

*Primary Examiner* — Arthur O. Hall
*Assistant Examiner* — Tuongminh N Pham
(74) *Attorney, Agent, or Firm* — Barlow, Josephs & Holmes, Ltd.

(57) ABSTRACT

A dosing dispenser system and a dosing dispenser include a rotatable control configured to allow a user to select a desired mixing ratio for a product contained in a container attached to the dosing dispenser with a transport medium, such as water, flowing through the dosing dispenser.

6 Claims, 9 Drawing Sheets

DOSING DISPENSERS AND METHODS FOR USING THE SAME

BACKGROUND OF THE INVENTION

Field of the Invention

Embodiments of the invention relate to dispensers for dosing a product from a container into a larger vessel and in particular for dosing chemical or product concentrates into a larger container utilizing an adjustable flow control system.

State of the Art

Dispensers of many different forms are used to dispense products as desired. Some dispensers are used to dispense a chemical concentrate at different flow rates into larger containers. For example, U.S. Pat. No. 6,988,675, which is incorporated herein by reference in its entirety, describes such systems.

While various flow control and chemical concentrate dispensers exist, many include a plethora of parts, are expensive to manufacture, and are difficult to assemble. Therefore, systems having fewer parts, less cost, or which are easier to manufacture and assemble are desirable.

BRIEF SUMMARY OF THE INVENTION

According to various embodiments of the invention, a dose dispensing system includes a bottle or container and a dosing dispenser attached thereto. The dosing dispenser may include a valve for regulating an amount of fluid flow from a container attached to the dosing dispenser through the dosing dispenser. In some embodiments of the invention, a valve or dose regulator may be combined with or part of a rotating component or dosing control of the dispenser allowing a user to "dial-in" a desired dose to be output with a stream of water.

BRIEF DESCRIPTION OF THE DRAWINGS

While the specification concludes with claims particularly pointing out and distinctly claiming particular embodiments of the invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to various embodiments of the invention, a dose dispensing system may include a bottle or container 900 and a dosing dispenser 100 attached thereto. The dosing dispenser 100 may include components as illustrated in FIGS. 1 through 9.

Figure 1:
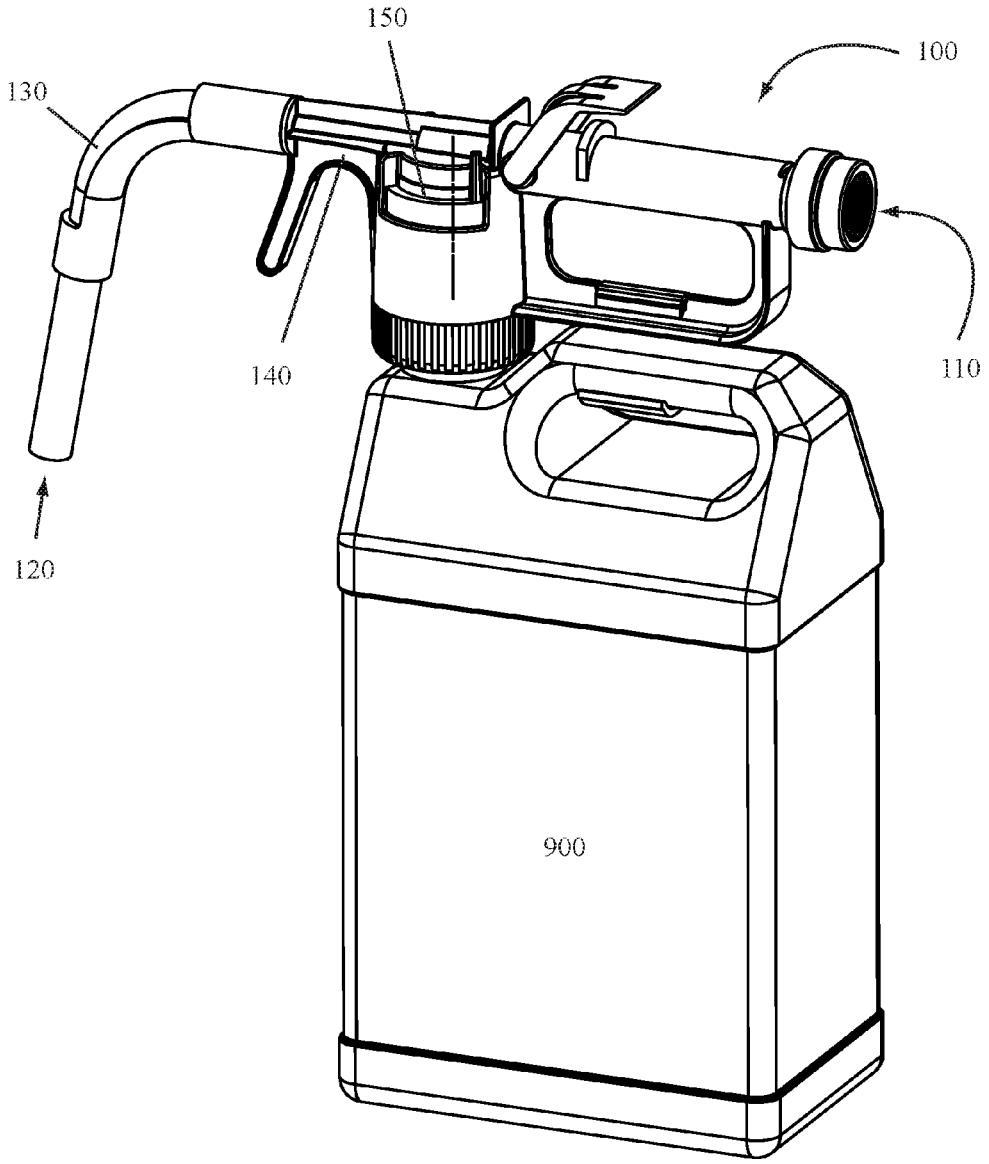
FIG. 1 illustrates a perspective view of a dose dispensing system according to various embodiments of the invention.
Figure 2:
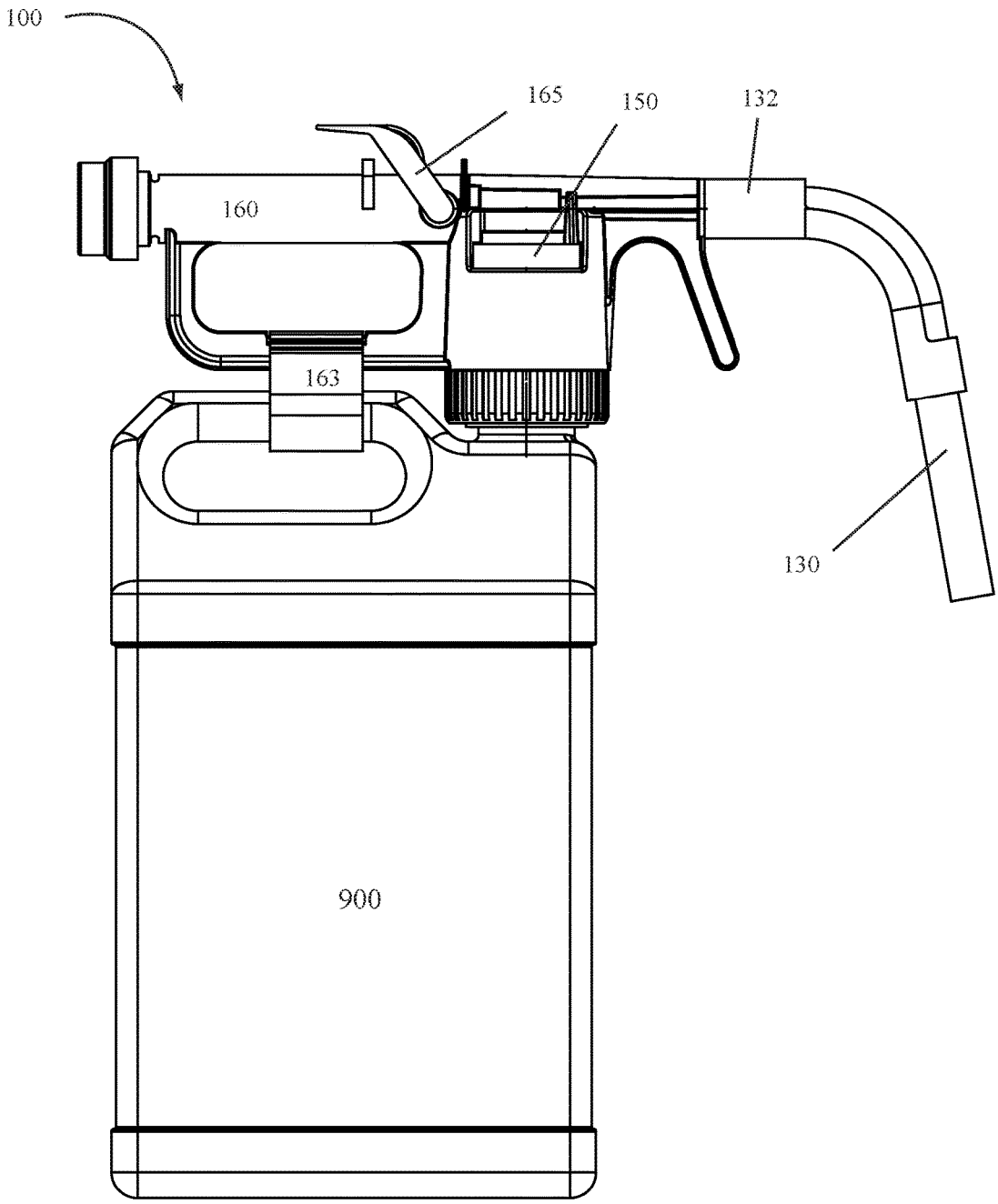
FIG. 2 illustrates a side view of a dose dispensing system according to various embodiments of the invention.
Figure 3:
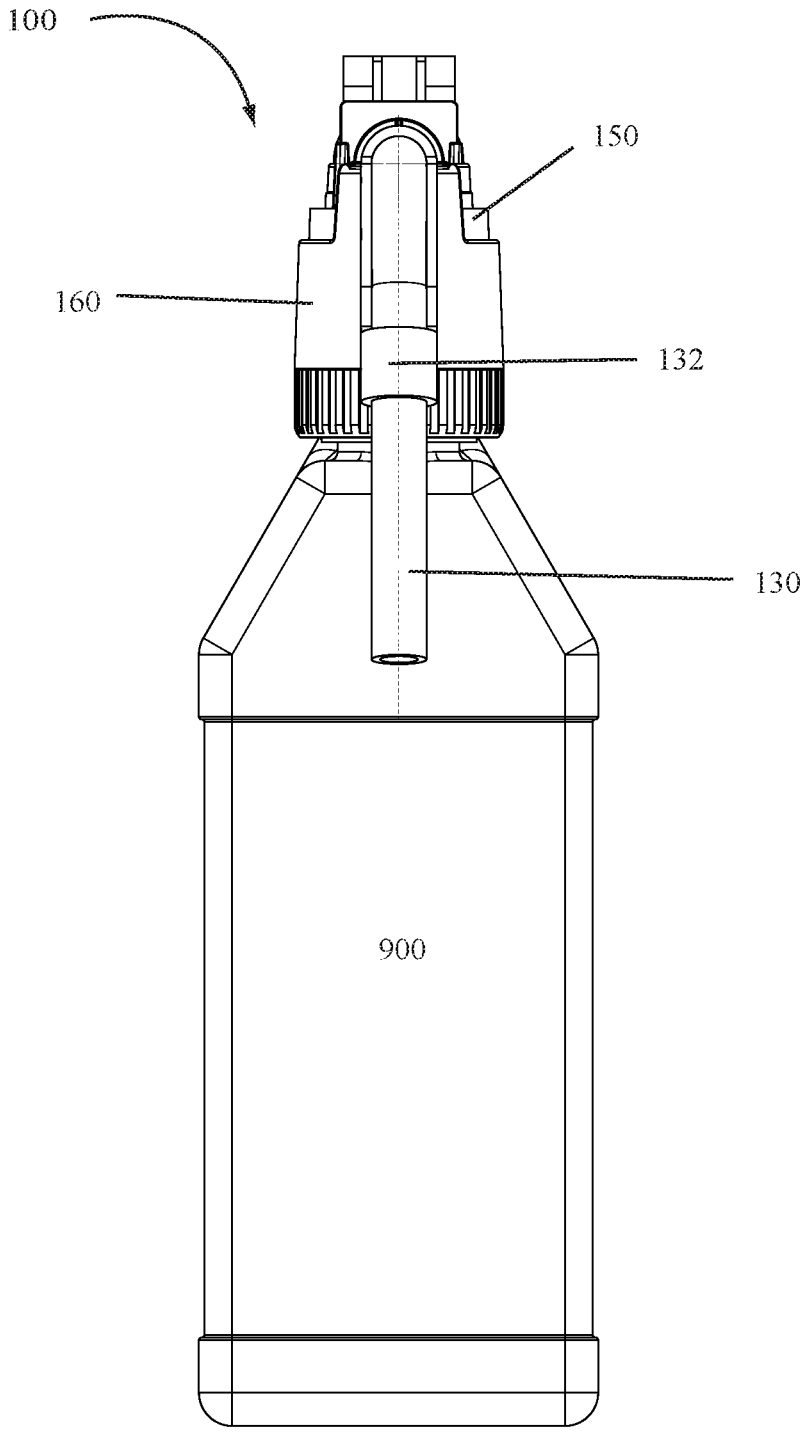
FIG. 3 illustrates a front view of a dose dispensing system according to various embodiments of the invention.
Figure 4:
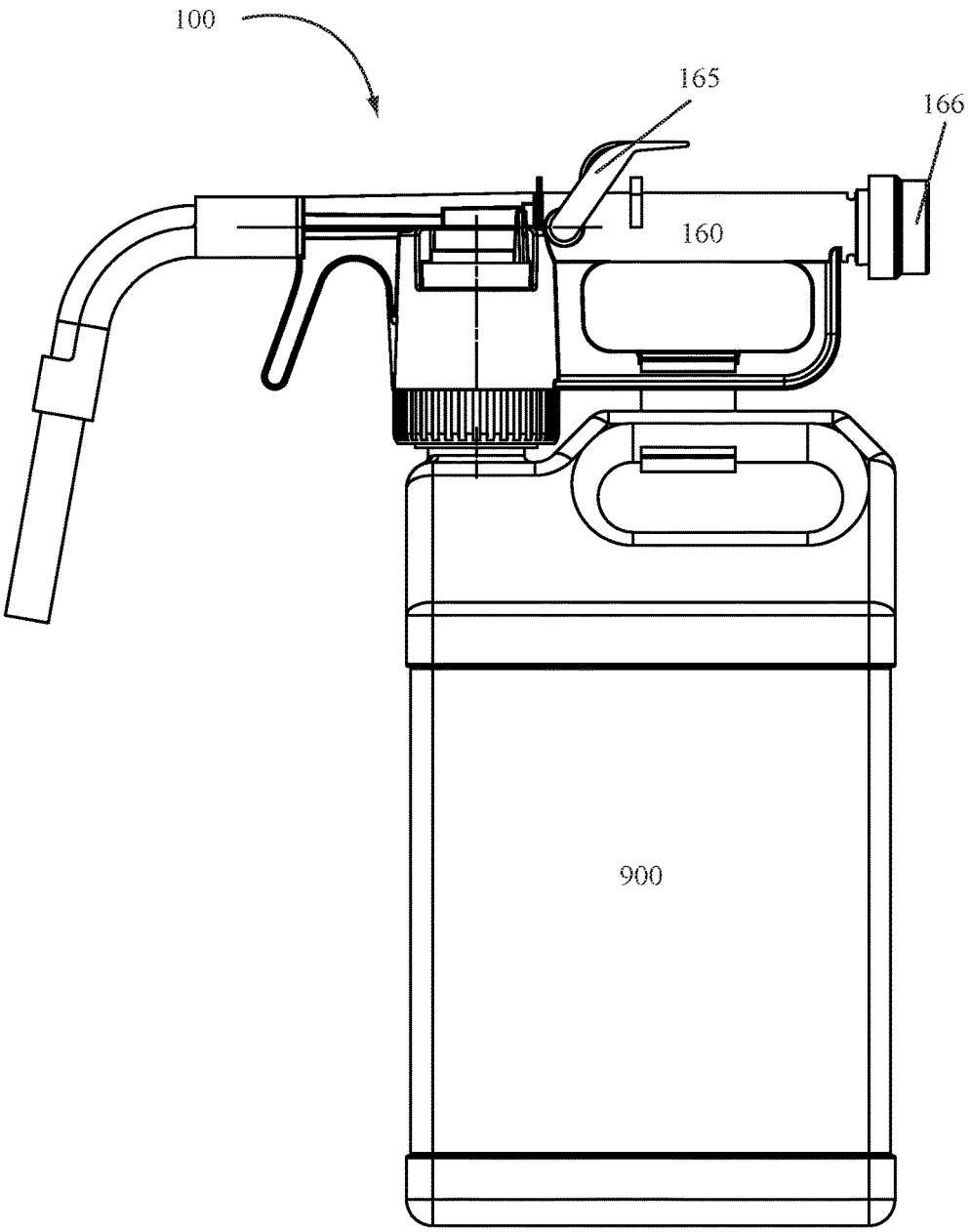
FIG. 4 illustrates a side view of a dose dispensing system according to various embodiments of the invention.
Figure 5:
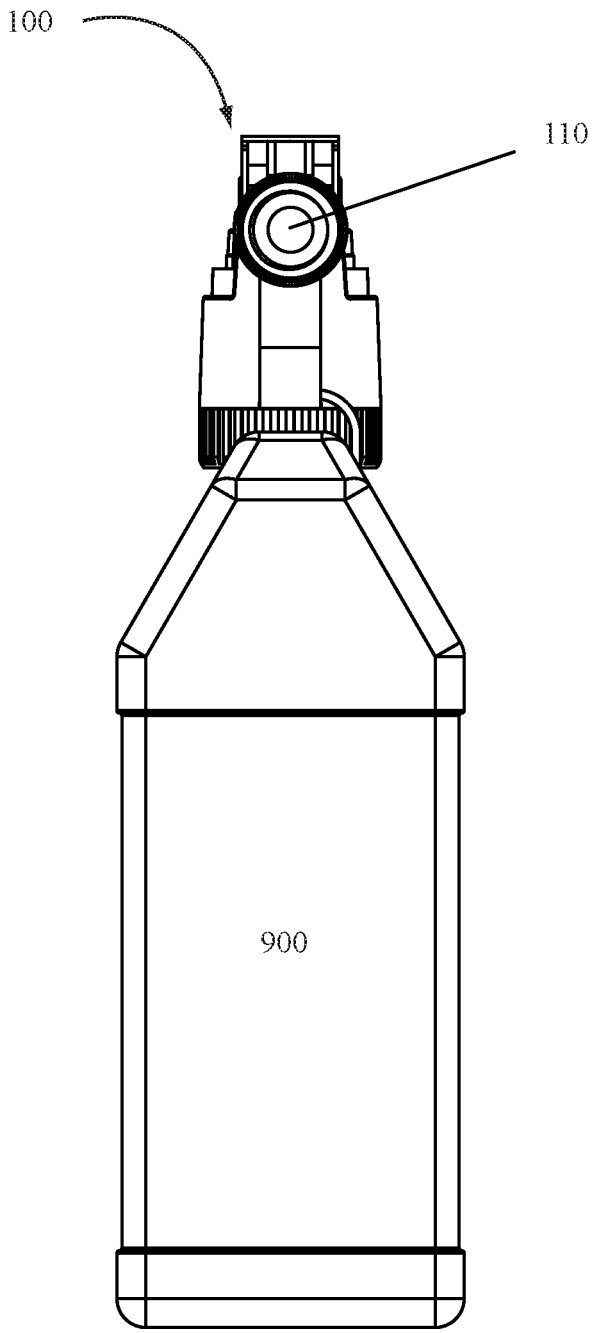
FIG. 5 illustrates a rear view of a dose dispensing system according to various embodiments of the invention.
Figure 6:
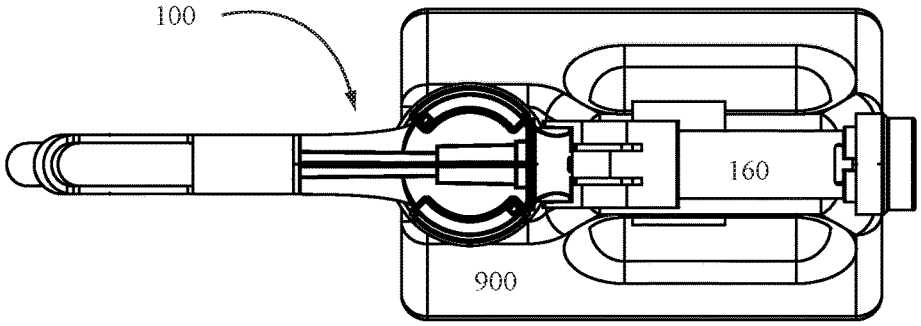
FIG. 6 illustrates a top view of a dose dispensing system according to various embodiments of the invention.
Figure 7:
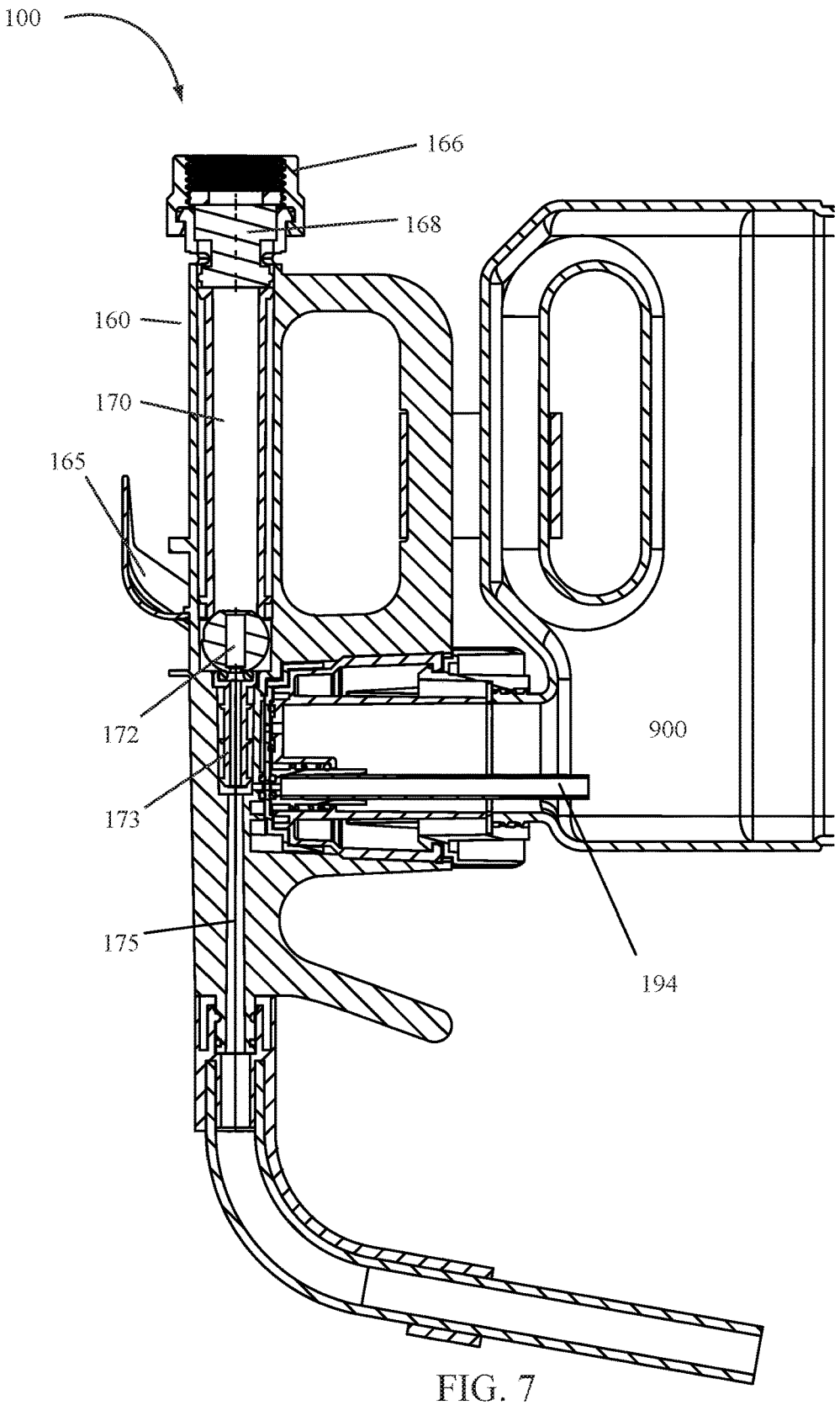
FIG. 7 illustrates a cross-sectional view of a dose dispensing system according to various embodiments of the invention.

According to certain embodiments of the invention, a dosing dispenser 100 may include an inlet 110 and an outlet 120. The inlet 110 may be connected to a water source or other transport medium that is configured to take up a product or chemical concentrate. For example, a hose may be screw-fit, snap-fit, quick-connect fitted, or otherwise connected to the dosing dispenser 100 at the inlet 110. As illustrated in FIG. 7, a threaded mating system may be used at the inlet 110 to connect the dosing dispenser 100 to a water source or other transport medium source. In other embodiments, a bayonet system may be used. In still other embodiments, a quick-connect system may be used.

The outlet 120 may be located at the end of a feeder tube 130. The feeder tube 130 may be angled in an appropriate direction to direct flow of water or a product laced transport medium in a desired direction. As illustrated in the Figures, in some embodiments it may be desirable for the feeder tube 130 to be pointed or directed in a downward direction towards a base of a container 900 attached to the dispenser 100.

A hanger portion 140 of the dosing dispenser 100 may be configured to allow the dosing dispenser 100 and container 900 to be hung on the side of a receptacle or other container such that the dosing dispenser 100 and container 900 may be supported by the receptacle or other container without the need for a user to hold the dispensing system. For example, the dosing dispenser 100 may be hung on the side of a pail or bucket such that a portion of the hanger portion 140 is on one side of the pail or bucket wall and another portion of the hanger portion 140 is on an opposite side of the pail or bucket wall. In some embodiments, the hanger portion 140 of the dosing dispenser 100 may include one or more projections defining a hanger portion crotch into which a wall of a pail or bucket may be positioned such that the dosing dispenser 100 can hang from the pail or bucket.

A container 900 may contain a product that can be siphoned into a flow of water or other transport medium flowing through the dosing dispenser 100. For example, using a venturi effect, a flow channel from the container 900 through a dip tube connected to the dosing dispenser 100 may pull product from the container 900 into a stream of water passing through the dosing dispenser 100.

According to certain embodiments of the invention, the flow rate of a concentrate or product in the container 900 may be controlled by movement of the dosing control 150. As illustrated, the dosing control 150 may include two selector posts 152 that allow a user to move or rotate the dosing control 150. While two selector posts 152 are illustrated, it is understood that one post may be used or that other features in place of the posts may be used to allow a user to rotate or move the dosing control 150. The dosing control 150 may be rotated to select a desired flow rate of concentrate or product from the container 900 into the dosing dispenser 100 to be mixed with a water or transport medium stream flowing through the dosing dispenser 100. The dosing control 150 may include an on position wherein some flow of product from the container 900 into a transport medium flowing through the dosing dispenser 100 occurs and an off position wherein no product from a container 900 is allowed to flow into the transport medium flowing through the dosing dispenser 100. In some embodiments, a user may rotate the dosing control 150 to allow only the flow of water or the transport medium through the dosing dispenser 100. In other embodiments, the dosing control 150 may be adjusted to allow a desired concentration of product from the container 900 to be drawn into the flow of water or transport medium.

Figure 8:
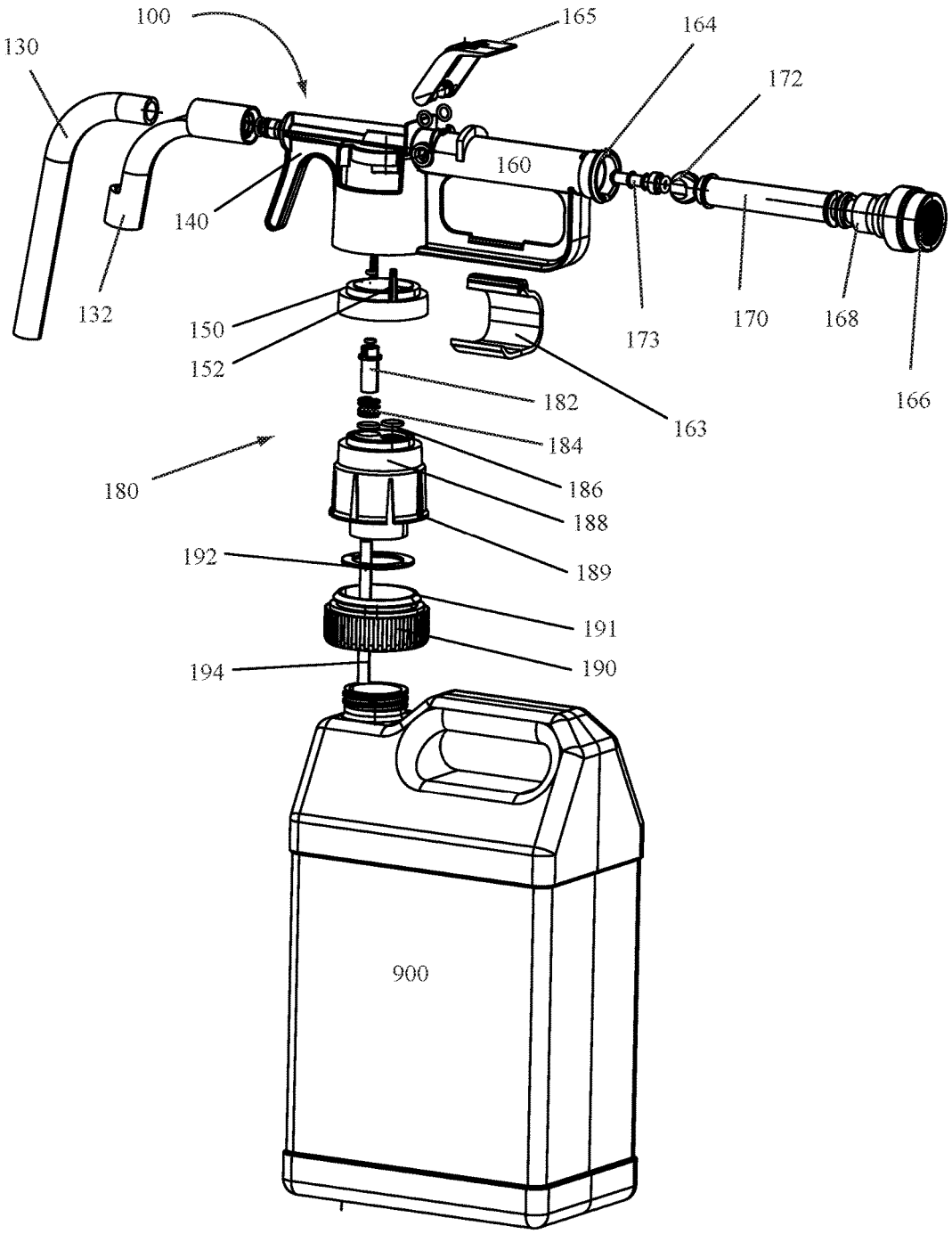
FIG. 8 illustrates the components of a dose dispensing system according to various embodiments of the invention.
Figure 9:
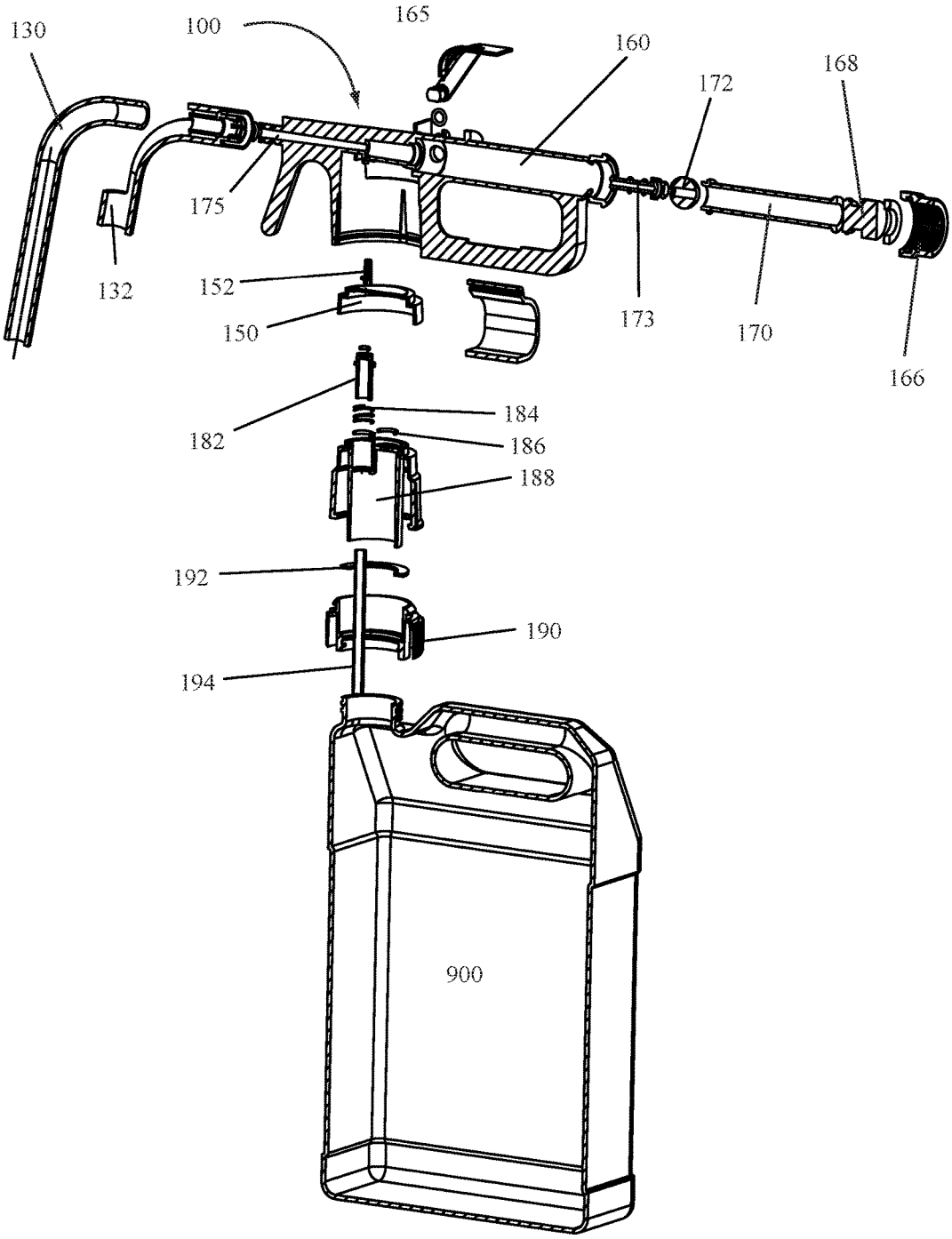
FIG. 9 illustrates a cross-sectional view of various components of a dose dispensing system according to certain embodiments of the invention.

Component parts of a dosing dispenser 100 according to certain embodiments of the invention are illustrated in FIG. 8. Cross-sectional views of the same component parts of a dosing dispenser 100 according to certain embodiments of the invention are illustrated in FIG. 9.

As illustrated, a dosing dispenser 100 according to certain embodiments of the invention may include a body 160 having a hollow interior with an inlet opening 164 at one end and a feeder tube connection 162 at an opposite end. The body 160 may include an integrally molded hanger portion 140. In other embodiments, a hanger portion 140 may be a separate component that connects to or snaps onto the body 160 of the dosing dispenser 100. The body 160 may also include a handle 161. The handle 161 may include an opening through which a user may insert their hand such that a portion of the body 160 may be gripped to hold the dosing dispenser 100. A clip 163 may be attached to a portion of the handle 161 and a portion of a container 900 to help secure the body 160 to the container 900.

A feeder tube 130 may be attached to the feeder tube connection 162 at one end of the body 160. In some embodiments of the invention, the feeder tube 130 may overlap the end of the feeder tube connection 162 in a fluid tight manner. In other embodiments, the feeder tube connection 162 may overlap the end of the feeder tube 130 in a fluid tight connection. As illustrated in FIGS. 8 and 9, a feeder tube guide 132 may also be attached to the body 160 at or adjacent to the feeder tube connection 162. For example, the feeder tube 130 may fit into the feeder tube guide 132 and the feeder tube 130 and feeder tube guide 132 may both attach to the body 160 at or adjacent to the feeder tube connection 162. In some embodiments, as illustrated in FIG. 7, a feeder tube 130 may be fit into a feeder tube guide 132 and the feeder tube guide 132 may be attached to the feeder tube connection 162. The feeder tube 130 may be snug-fit or otherwise fit into the feeder tube guide 132. The feeder tube guide 132 may be snap-fit or otherwise attached to the feeder tube connection 162. One or more o-rings or other interference components may also be used with the attachment to facilitate a fluid-tight seal at the connection location.

Components of the dosing dispenser 100 may also include a connector 166 attached to a backflow prevention device 168 which is connected to or is in fluid communication with a flow tube 170. In other embodiments of the invention, a backflow prevention device 168 may be substituted with a flow channel device which allows the free flow of a fluid or transport medium therethrough. In some embodiments, a flow guide 173 may be assembled in an interior cavity of the body 160 through the inlet opening 164. A valve 172 is inserted against the flow guide 173 and may be moved by lever 165 from an open to closed position (or an on and off position). In the open or on position, a transport medium or water attached to the dosing dispenser 100 may flow through the dosing dispenser 100. In a closed or off position, a transport medium or water entering the inlet 110 is prevented from flowing past the valve 172. A flow tube 170, backflow prevention device 168 and connector system 166 may be inserted into the inlet opening 164 adjacent the valve 172.

In operation, a transport medium source—such as a water source or hose—may be connected to the connector system 166 of the dosing dispenser 100. The transport medium may flow into and through the backflow prevention device 168 into an interior portion of the flow tube 170. At an end of the flow tube 170, the valve 172 is seated. In an open or on position, the valve 172 allows the transport medium to flow through the valve 172 and into the flow guide 173. Transport medium then flows into an interior passageway 175 in the body 160 and then into the feeder tube 130, where it exits the outlet 120. In a closed or off position, the valve 172 prevents flow of the transport medium past the valve 172. The valve 172 may be controlled by the lever 165.

According to some embodiments of the invention, a lever 165 may be attached to the body 160 and to the valve 172. Movement of the lever 165 provides movement of the valve 172 into an open or on position and into a closed or off position. The lever 165 may be connected to the body 160 and valve 172 in any desired manner. One or more o-rings or other interference devices may be used with the attachment of the lever 165 to the body 160 to ensure a fluid-tight seal at the attachment position.

A dosing dispenser 100 according to various embodiments of the invention may also include a dosing control 150. A dosing control 150 may be inserted into an opening in the body 160 and may include one or more selector posts 152. The selector posts 152 may facilitate movement or rotation of the dosing control 150. The selector posts 152, portions of the dosing control 150, or both may be accessible to a user through one or more windows in the body 160.

A dose control system 180 may include a housing 188, a product valve 182, a spring 184, one or more o-rings 186 and the dosing control 150. The housing 188 may include a dip tube connection for retaining a dip tube 194 therein. The product valve 182 may sit in an opening in the housing 188 with the spring 184 and an o-ring 186 seated between the product valve 182 and the housing 188. The dosing control 150 may sit on the housing 188 with the product valve 182 and spring 184 seated therebetween. Rotation of the dosing control 150 applies pressure to the product valve 182 to either open or close the product valve 182. For instance, in a closed position, the dosing control 150 applies sufficient pressure to the product valve 182 to close the product valve 182 against the housing 188 or an o-ring 186 seated in a valve seat or opening of the housing 188. As the dosing control 150 is rotated, the force on the product valve 182 may be lessened, allowing the spring 184 to open or unseat the product valve 182, creating a passageway from a dip tube 194 through the dose control system 180.

The dose control system 180 may be connected to a closure 190. For example, the housing 188 may include one or more housing rims 189 that snap-fit or otherwise join or create a retention connection with a closure rim 191. When the closure 190 is attached to a container 900, the closure 190 may retain the housing 188 and hold the body 160 and other parts of the dosing system 100 on the container 900.

In some embodiments of the invention, a gasket 192 may be positioned between the closure 190 and the housing 188. The gasket 192 may help create a fluid-tight seal between the closure 190 and the housing 188 such that a product contained in the container 900 will not leak out between the closure 190 and housing 188.

A dip tube 194 may be attached to the housing 188. For instance, a housing 188 may include a dip tube retention feature into or around which a dip tube 194 may be inserted. The dip tube 194 may extend down into the container 900 for delivering a product from within the container 900 to the dosing control 150.

In operation, the dosing dispenser 100 may be attached to a container 900 containing a product. The dosing dispenser 100 may also be attached to a transport medium source, such as a water source. The water source—such as a hose—may be attached to the connector 166. When the water source is turned on and begins to deliver water to the dosing dispenser 100, the water flows into the flow tube 170 to a valve 172. If the valve 172 is in an open position—such as when the lever 165 is fully engaged—water flows through the valve 172, into a flow guide 173, into a flow passageway 175 in the body 160, and then into the feeder tube 130 before exiting the dosing dispenser 100 at the outlet 120. When water passes from the flow guide 173 into the flow passageway 175, the water passes over a product inlet in fluid communication with the dose control system 180 and the product in the container 900. If the dose control system is in an off position—where the dosing control 150 has shut the product valve 182—no product flows through the product inlet and water is the only product delivered to the feeder tube 130. If the dose control system 180 is in a configuration to allow product from the container 900 to pass the product valve 182, product is pulled by venturi effect from the container 900, into the dip tube 194, past the product valve 182 and into the product inlet where it mixes with the water flowing from the flow guide 173 into the flow passageway 175.

Depending on the amount of product desired in a water stream—or transport medium stream—a user may rotate the dosing control 150 to adjust the amount of product being allowed through the product valve 182. As the dosing control 150 is rotated, it applies a varying amount of pressure on the product valve 182 to open or close the product valve 182 and adjust the amount of product flowing therethrough.

As illustrated, various components are assembled to construct a dosing dispenser 100 according to various embodiments of the invention. While such components may be used to construct the dosing dispenser 100, other configurations may be used with various embodiments of the invention as well.

While various embodiments of the invention are described herein, it is understood that the particular embodiments defined by the appended claims are not to be limited by particular details set forth in the description, as many apparent variations thereof are contemplated. Rather, embodiments of the invention are limited only by the appended claims, which include within their scope all equivalent devices or methods which operate according to the principles of the embodiments of the invention described.

What is claimed is:

1. A dose dispensing system, comprising:

a container having an orifice having an axis extending therethrough;

a product contained in the container; and a dosing dispenser connected to the container, the dosing dispenser comprising:

a body, comprising:

an inlet opening at one end of the body;

a feeder tube connection at an opposite end of the body;

a cylindrical wall portion extending downward from the body, the cylindrical wall portion being coaxially aligned with the axis of the orifice, at least one window disposed through the cylindrical wall portion; and a flow passage, a lever connected to the body;

a valve connected to the lever;

a feeder tube guide connected to the body;

a feeder tube connected to the feeder tube guide;

a flow guide adjacent the flow passage;

a valve adjacent the flow guide;

a flow tube adjacent the valve;

a connector in fluid communication with the flow tube and connected to the inlet opening of the body;

a dosing control system, comprising:

a dosing control disc;

at least one selector post disposed on the dosing control disc;

a product valve;

a spring; and a housing, wherein the spring is positioned between the product valve and the housing, the product valve seats in a valve in the housing, and the dosing control disc is positioned over the product valve and in communication with the product valve, the dosing control disc being rotatable by application of a force to the at least one selector post through the at least one window, rotation of the dosing control disc configured to apply varying forces to the product valve to regulate a flow of the product through the product valve as a function of the varying forces;

a closure attached to the housing; and a dip tube attached to the housing, wherein the rotatable dosing control disc is rotatable about an axis which is substantially parallel to the axis extending through the orifice of the container.

2. The dose dispensing system of claim 1, wherein the body further comprises a handle extending downward therefrom.

3. The dose dispensing system of claim 2, further comprising a clip which secures the handle to the container.

4. The dose dispensing system of claim 1, further comprising a gasket between the housing and the closure.

5. The dose dispensing system of claim 1, wherein the at least one selector post is disposed radially inward of the cylindrical wall.

6. The dose dispensing system of claim 1, wherein the dosing control system further includes a plurality of housing rims extending from the housing, said plurality of housing rims being snap-fit to the closure.

* * * * *